US009222398B2

(12) United States Patent
Mehring et al.

(10) Patent No.: US 9,222,398 B2
(45) Date of Patent: Dec. 29, 2015

(54) COOLING SYSTEM

(75) Inventors: Jan Mehring, Cologne (DE); Kai Sebastian Kuhlbach, Bergisch Gladbach (DE); Bernd Steiner, Bergisch Gladbach (DE); Michael Tobergte, Cologne (DE); Hans Guenter Quix, Herzogenrath (DE)

(73) Assignee: Ford Global Technologies, LLC, Dearborn, MI (US)

( * ) Notice: Subject to any disclaimer, the term of this patent is extended or adjusted under 35 U.S.C. 154(b) by 507 days.

(21) Appl. No.: 13/278,970

(22) Filed: Oct. 21, 2011

(65) Prior Publication Data

US 2012/0103283 A1 May 3, 2012

(30) Foreign Application Priority Data

Nov. 3, 2010 (DE) ..... 10 2010 060319

(51) Int. Cl.

| | |
|---|---|
| ***F02F 1/10*** | (2006.01) |
| ***F02F 1/14*** | (2006.01) |
| ***F01P 9/00*** | (2006.01) |
| ***F01P 3/02*** | (2006.01) |
| *F01P 11/02* | (2006.01) |
| *F01P 5/10* | (2006.01) |

(52) U.S. Cl.

CPC ..... *F01P 3/02* (2013.01); *F01P 11/029* (2013.01); *F01P 2003/028* (2013.01); *F01P 2005/105* (2013.01); *F01P 2060/08* (2013.01); *F01P 2060/12* (2013.01)

(58) Field of Classification Search

CPC ..... F01P 3/20; F01P 11/04; F01P 11/06; F01P 3/02; F02F 1/10; F02F 1/14; F02F 1/16

USPC ..... 123/41.1, 41.01, 41.02, 41.05, 41.79; 701/112, 113

See application file for complete search history.

(56) References Cited

U.S. PATENT DOCUMENTS

| | | | | |
|---|---|---|---|---|
| 4,369,738 | A | 1/1983 | Hirayama | |
| 6,616,059 | B2 * | 9/2003 | Sabhapathy et al. | 237/12.3 B |
| 6,928,962 | B2 * | 8/2005 | Yamazaki | 123/41.05 |
| 7,128,026 | B2 * | 10/2006 | Braun et al. | 123/41.01 |

(Continued)

FOREIGN PATENT DOCUMENTS

| | | | |
|---|---|---|---|
| DE | 19914999 | A1 | 10/1999 |
| DE | 102009054814 | A1 | 6/2001 |

(Continued)

OTHER PUBLICATIONS

Partial Translation of Office Action of Chinese Application No. 201110348199.3, Issued Apr. 3, 2015, State Intellectual Property Office of PRC, 9 Pages.

*Primary Examiner* — Lindsay Low
*Assistant Examiner* — Syed O Hasan
(74) *Attorney, Agent, or Firm* — Julia Voutyras; Alleman Hall McCoy Russell & Tuttle LLP

(57) ABSTRACT

A cooling system for an engine is provided. In one embodiment, an internal combustion engine comprises a cabin heat exchanger circuit including a connecting line opening on an inlet side into a cylinder block coolant jacket, a main coolant pump arranged in the cabin heat exchanger circuit, an auxiliary coolant pump arranged in the connecting line, and a check valve. In this way, additional cooling and/or heating may be provided to the engine and associated components by the auxiliary coolant pump.

17 Claims, 4 Drawing Sheets

(56) References Cited

U.S. PATENT DOCUMENTS

| | | | | |
|---|---|---|---|---|
| 8,430,151 | B2 * | 4/2013 | Kim | 165/41 |
| 2004/0031452 | A1 | 2/2004 | Yamazaki | |
| 2007/0137592 | A1 * | 6/2007 | Hanai | 123/41.14 |
| 2008/0168956 | A1 * | 7/2008 | Lutz et al. | 123/41.1 |
| 2011/0180026 | A1 * | 7/2011 | Heusler | 123/41.44 |

FOREIGN PATENT DOCUMENTS

| | | | |
|---|---|---|---|
| DE | 10210303 | A1 | 10/2003 |
| DE | 102006044680 | A1 | 4/2008 |

* cited by examiner

COOLING SYSTEM

RELATED APPLICATIONS

The present application claims priority to German Patent Application No. 102010060319.8, filed on Nov. 3, 2010, the entire contents of which are hereby incorporated by reference for all purposes.

FIELD

The disclosure relates to an internal combustion engine which has a coolant circuit.

BACKGROUND AND SUMMARY

Conventional cooling systems have at least one head coolant jacket, one block coolant jacket, a main coolant pump that frequently is a mechanical pump, an auxiliary coolant pump that frequently is an electric pump, a radiator, a thermostat, a heat exchanger, a vapor separator, and further components and corresponding connecting lines. Below a specific coolant temperature of, for example, 90° C., the coolant flows through the main coolant pump, the coolant jackets, the heat exchanger, the oil cooler, the vapor separator and the thermostat, i.e. through the "small cooling circuit". Once the specific temperature has been reached, the thermostat opens and, as a result, the coolant additionally flows through the radiator in parallel with the heat exchanger.

The practice of allowing separate flows of a coolant in a coolant circuit through the engine block and the cylinder head of the internal combustion engine, respectively, is known. In this way, the cylinder head, which is coupled to the combustion air especially by the combustion chamber and port walls, and the engine block, which is coupled thermally especially to the friction points, can be cooled differently. A "split cooling concept" (separate coolant circuit) is intended to ensure that the cylinder head is cooled when the internal combustion engine is in the warm-up phase, the intention being that there should initially be no cooling of the engine block, thus allowing the engine block to be brought to the required operating temperature more quickly.

In order to improve the warm-up behavior of the internal combustion engine, a "no-flow strategy" can be employed, in which there is no flow of coolant through the block water jacket. For this purpose, an additional shutoff valve is provided, with the thermostat being replaced by a proportional valve and the mechanical pump furthermore being replaced by an electric pump. The mechanical pump is driven the internal combustion engine, and the electric pump is driven by a controllable electric motor.

As an alternative, it is therefore possible to improve the warm-up behavior by combining the split-cooling concept with the no-flow strategy, the result being that the cylinder block is not cooled while the cylinder head is cooled.

However, the prior systems also may include the practice of providing internal combustion engines with an auxiliary coolant pump in order to improve the endurance of the internal combustion engine, especially the turbocharger thereof, in "hot soak phases", i.e. in phases after an engine has been switched off in a warm environment.

According to the current conventional construction, exhaust turbochargers have a rotor with a compressor impeller and a turbine wheel and a shaft which is arranged between the compressor impeller and the turbine wheel and is rotatably mounted on the turbine side and on the compressor side in corresponding rotor bearings. The rotor bearings may generally be plain bearings or rolling contact bearings with oil lubrication. The bearings are generally supplied with a lubricant, e.g. engine oil, which is passed to the individual bearing locations via a pressure line, for example. In addition to lubricating the bearings, the purpose of the lubricant is also to cool the latter. Cooling is very important, especially for the turbine-side bearings since a significant amount of heat is introduced into the shaft by the hot turbine wheel.

An operating state which is particularly difficult to manage for this reason is the rapid shutdown of the internal combustion engine from an operating state involving a high load. The supply of lubricant is interrupted when stopping, and the dissipation of heat from the shaft is no longer assured. The result is overheating of the lubricating oil and associated carbonization of the lubricating oil remaining in the exposed parts of the bearing assembly owing to the continued heating of the shaft caused by the hot turbine. Ultimately, the carbonization of the lubricating oil leads to fouling of the rotor bearings and this frequently causes damage to the turbocharger.

The abovementioned critical operating state, i.e. the rapid shutdown of the internal combustion engine from an operating state involving a high load, can be observed especially on motor vehicles with an "automatic start/stop system" since this system automatically switches off the internal combustion engine if there is no need for motive power to drive the motor vehicle (stop state), e.g. when stopping at a traffic light.

To avoid this, provision is made to incorporate the turbine casing into the coolant circuit and to cool it by means of the electric auxiliary coolant pump by bringing about a flow of coolant in the turbine casing.

However, the electric auxiliary coolant pump is also supposed to supply the cabin heat exchanger with coolant during the stop phases of the internal combustion engine. It is helpful in such cases to use what are as it were additional sources of heat, such as the turbine casing and/or exhaust manifolds integrated into the cylinder head.

During the warm-up phase, however, the coolant limit temperature (specific temperature), in the turbine casing, for example, and/or of the exhaust manifold may be reached sooner than in other areas, such as in the cylinder block and/or at the fresh air side of the cylinder head. Thus, the "no-flow strategy", for example, is abandoned owing to the high coolant temperature even though the cylinder liners, for example, have still not heated up and are therefore virtually cold.

The inventors herein have recognized the issues with the above approaches and provide an engine system to at least partly address them. In one embodiment, an internal combustion engine comprises a cabin heat exchanger circuit including a connecting line opening on an inlet side into a cylinder block coolant jacket, a main coolant pump arranged in the cabin heat exchanger circuit, an auxiliary coolant pump arranged in the connecting line, and a check valve.

In this way heating passenger cabin and cooling of the engine and/or turbine may be supplemented with an auxiliary coolant pump while providing a simplified system, thus increasing engine efficiency and further improving the cooling and/or warm-up behavior of the internal combustion engine.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
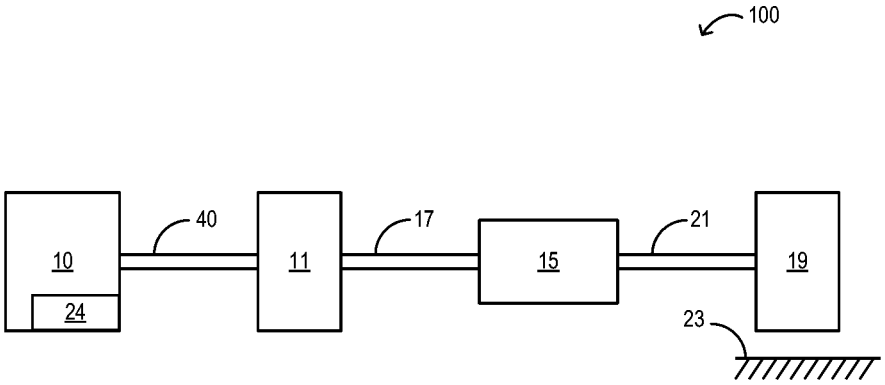
FIG. 1 shows an example vehicle system layout, including a vehicle powertrain.

FIG. 1 shows a vehicle system 100 including internal combustion engine 10 coupled to torque converter 11 via crankshaft 40. Engine 10 may be a gasoline engine. In alternate embodiments, other engine configurations may be employed, for example a diesel engine. Engine 10 may be started with an engine starting system 24, including a starter, and one or more starter gears. In one example, the starter may be motor-driven (e.g. battery-driven or capacitor driven). In another example, the starter may be a powertrain drive motor, such as a hybrid powerplant connected to the engine by way of a coupling device. The coupling device may include a transmission, one or more gears, and/or any other suitable coupling device. The starter may be configured to support engine restart at low non-zero engine speeds, such as, for example at or below 50 rpm. Alternatively, the engine may be restarted in a low speed range, for example between 50 to 100 rpm. Alternatively, the engine may be restarted in a higher speed range, for example above 200 rpm.

Torque converter 11 is also coupled to transmission 15 via turbine shaft 17. Torque converter 11 has a bypass clutch (not shown) which can be engaged, disengaged, or partially engaged. When the clutch is either disengaged or being disengaged, the torque converter is said to be in an unlocked state. Turbine shaft 17 is also known as a transmission input shaft. In one embodiment, transmission 15 comprises an electronically controlled transmission with a plurality of selectable discrete gear ratios. Transmission 15 may also comprises various other gears, such as, for example, a final drive ratio (not shown). Alternatively, transmission 15 may be a continuously variable transmission (CVT).

Transmission 15 may further be coupled to tire 19 via axle 21. Tire 19 interfaces the vehicle (not shown) to the road 23. Note that in one example embodiment, this power-train is coupled in a passenger vehicle that travels on the road. While various vehicle configurations may be used, in one example, the engine is the sole motive power source, and thus the vehicle is not a hybrid-electric, hybrid-plug-in, etc. In other embodiments, the method may be incorporated into a hybrid vehicle.

Figure 2:
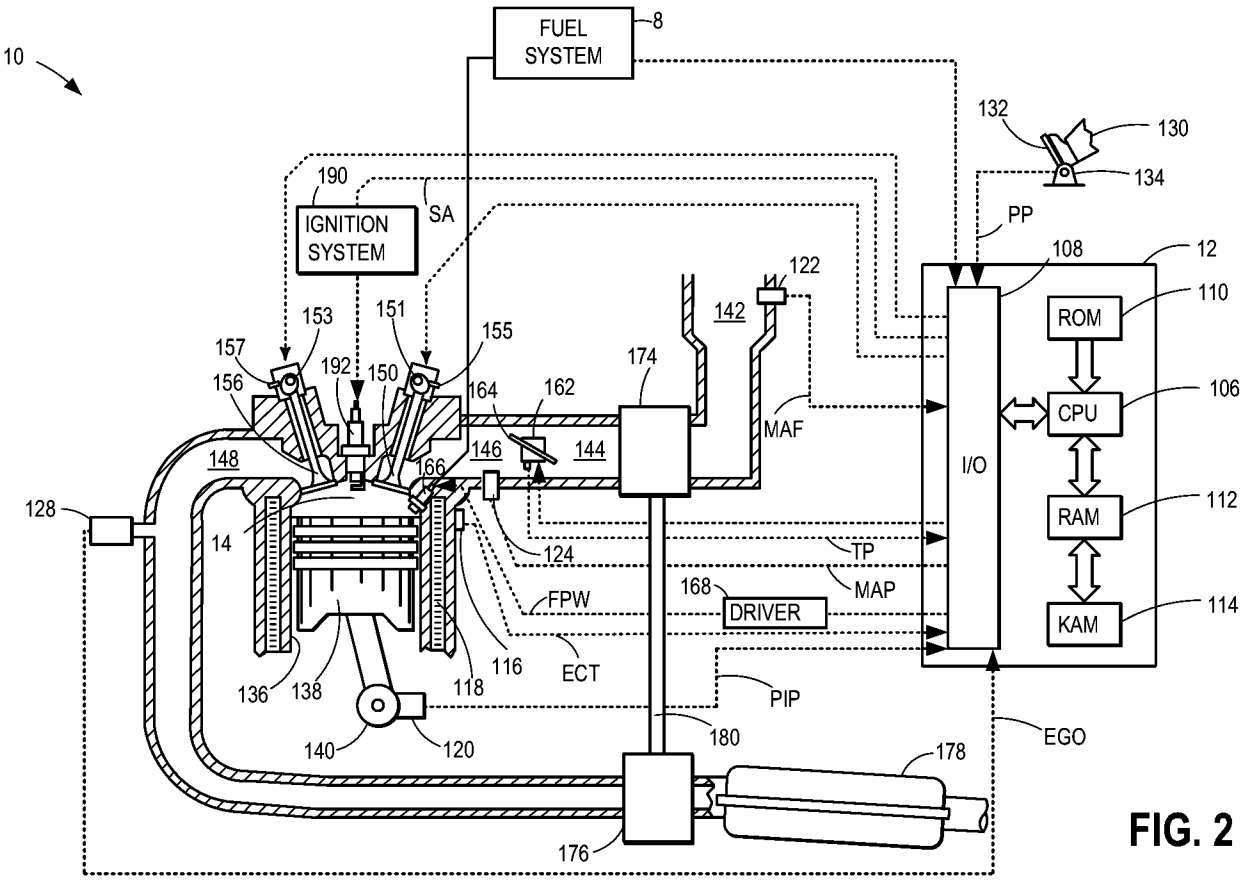
FIG. 2 shows a partial engine view.

FIG. 2 depicts an example embodiment of a combustion chamber or cylinder of internal combustion engine 10 (of FIG. 1). Engine 10 may receive control parameters from a control system including controller 12 and input from a vehicle operator 130 via an input device 132. In this example, input device 132 includes an accelerator pedal and a pedal position sensor 134 for generating a proportional pedal position signal PP. Cylinder (herein also "combustion chamber") 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some embodiments, one or more of the intake passages may include a boosting device such as a turbocharger or a supercharger. For example, FIG. 2 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be disposed downstream of compressor 174 as shown in FIG. 2, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Exhaust temperature may be estimated by one or more temperature sensors (not shown) located in exhaust passage 148. Alternatively, exhaust temperature may be inferred based on engine operating conditions such as speed, load, air-fuel ratio (AFR), spark retard, etc. Further, exhaust temperature may be computed by one or more exhaust gas sensors 128. It may be appreciated that the exhaust gas temperature may alternatively be estimated by any combination of temperature estimation methods listed herein.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some embodiments, each cylinder of engine 10, including cylinder 14, may include at least two intake poppet valves and at least two exhaust poppet valves located at an upper region of the cylinder.

Intake valve 150 may be controlled by controller 12 by cam actuation via cam actuation system 151. Similarly, exhaust valve 156 may be controlled by controller 12 via cam actuation system 153. Cam actuation systems 151 and 153 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 150 and exhaust valve 156 may be determined by valve position sensors 155 and 157, respectively. In alternative embodiments, the intake and/or exhaust valve may be controlled by electric valve actuation. For example, cylinder 14 may alternatively include an intake valve controlled via electric valve actuation and an exhaust valve controlled via cam actuation including CPS and/or VCT systems. In still other embodiments, the intake and exhaust valves may be controlled by a common valve actuator or actuation system, or a variable valve timing actuator or actuation system.

In some embodiments, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some embodiments, each cylinder of engine 10 may be configured with one or more fuel injectors for providing fuel thereto. As a non-limiting example, cylinder 14 is shown including one fuel injector 166. Fuel injector 166 is shown coupled directly to cylinder 14 for injecting fuel directly therein in proportion to the pulse width of signal FPW received from controller 12 via electronic driver 168. In this manner, fuel injector 166 provides what is known as direct injection (hereafter also referred to as "DI") of fuel into combustion cylinder 14. While FIG. 2 shows injector 166 as a side injector, it may also be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a high pressure fuel system 8 including fuel tanks, fuel pumps, and a fuel rail. Alternatively, fuel may be delivered by a single stage fuel pump at lower pressure, in which case the timing of the direct fuel injection may be more limited during the compression stroke than if a high pressure fuel system is used. Further, while not shown, the fuel tanks may have a pressure transducer providing a signal to controller 12. It will be appreciated that, in an alternate embodiment, injector 166 may be a port injector providing fuel into the intake port upstream of cylinder 14.

As described above, FIG. 2 shows only one cylinder of a multi-cylinder engine. As such each cylinder may similarly include its own set of intake/exhaust valves, fuel injector(s), spark plug, etc.

Fuel tanks in fuel system 8 may hold fuel with different fuel qualities, such as different fuel compositions. These differences may include different alcohol content, different octane, different heat of vaporizations, different fuel blends, and/or combinations thereof etc.

Controller 12 is shown in FIG. 2 as a microcomputer, including microprocessor unit 106, input/output ports 108, an electronic storage medium for executable programs and calibration values shown as read only memory chip 110 in this particular example, random access memory 112, keep alive memory 114, and a data bus. Storage medium read-only memory 110 can be programmed with computer readable data representing instructions executable by processor 106 for performing the methods and routines described below as well as other variants that are anticipated but not specifically listed. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; absolute manifold pressure signal (MAP) from sensor 124, cylinder AFR from EGO sensor 128, and abnormal combustion from a knock sensor and a crankshaft acceleration sensor. Engine speed signal, RPM, may be generated by controller 12 from signal PIP. Manifold pressure signal MAP from a manifold pressure sensor may be used to provide an indication of vacuum, or pressure, in the intake manifold.

Figure 3:
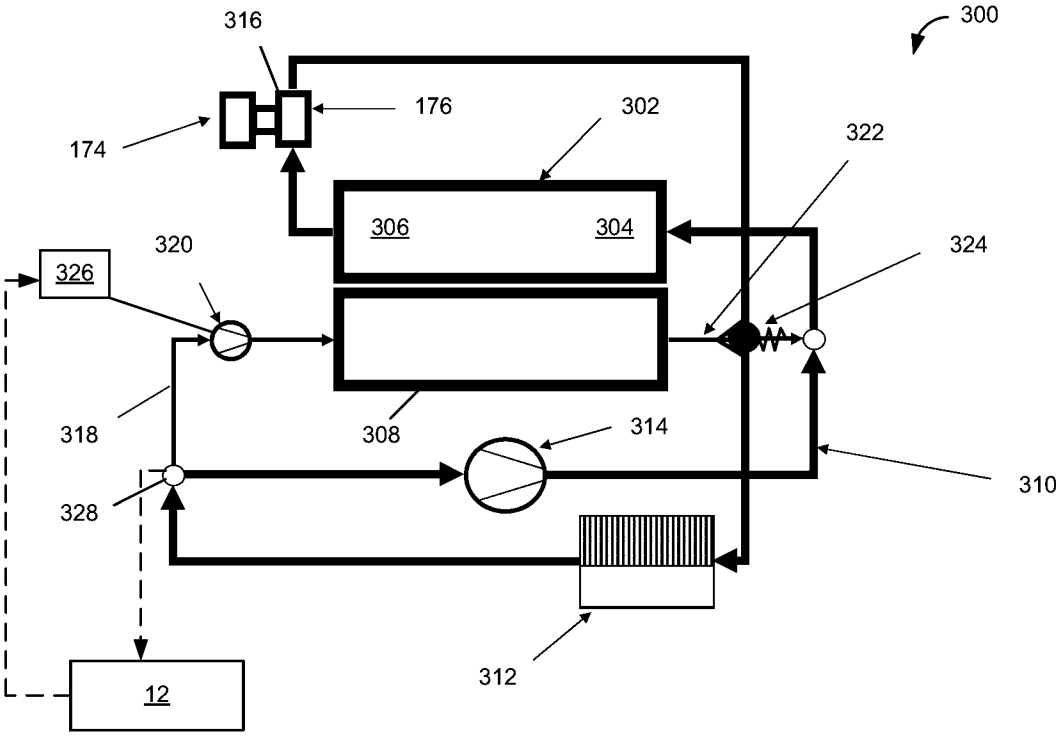
FIG. 3 shows a coolant circuit according to the disclosure for an internal combustion engine.

Turning to FIG. 3, a split-cooling system 300 for cooling an engine, such as engine 10, is shown, in which a cylinder head jacket 302 can have an outlet-side 306 and an inlet-side cooling zone 304, and a block water jacket 308 separated from the cylinder head water jacket 302 is provided, although said block water jacket 308 can be in contact with the inlet-side cooling zone 304 of the head (through the cylinder head gasket). However, components such as a vapor separator, radiator, block thermostat, lines, bypass and oil cooler are not shown.

FIG. 3 shows a first coolant loop, or a cabin heat exchanger circuit 310, in which a cabin heat exchanger 312 and a main coolant pump 314 are arranged. Starting from the main coolant pump 314, the coolant flows into the cylinder head jacket 302 and, flowing out from there, flows through a turbine casing 316 of the turbocharger turbine 176. From the turbocharger turbine 176 or, more specifically, from the turbine casing 316, the coolant flows to the cabin heat exchanger 312 and back to the main coolant pump 314.

Branching off from the cabin heat exchanger circuit 310, upstream of the main coolant pump 314, is a second loop including a connecting line 318, which opens into the block water jacket 308 on the inlet side. The auxiliary coolant pump 320 is arranged in the connecting line 318. A line 322, which opens into the cabin heat exchanger circuit 310, is provided on the outlet side of the cylinder block water jacket 308. A control element 324, preferably embodied as a simple check valve, is arranged in the line 322.

As is apparent, a cooling system of significantly less complex construction for improving the warm-up behavior of the internal combustion engine 10 and the endurance thereof, especially that of components subject to high and low thermal stress, can be achieved with the arrangement according to the disclosure of the main coolant pump 314 and the auxiliary coolant pump 320 and a simple check valve 324. A very simple cooling strategy through appropriate control of the main coolant pump 314 and of the auxiliary coolant pump 320 can also be achieved.

Operation of the auxiliary coolant pump 320 may be controlled by controller 12. For example, a motor 326 may drive the auxiliary pump 320, and the controller 12 may be configured to switch on or off the motor 326, or operate it at a variable speed. Operation of the auxiliary coolant pump 320 may be in response to heat demand of the passenger cabin. The passenger cabin may be heated via the cabin heat exchanger 312. The heat demand may be determined by a temperature of the coolant after passing through the heat exchanger 312, sensed by a sensor 328, for example. In one embodiment, the higher temperature of the coolant sensed by sensor 328, the lower the heat demand, while the lower the coolant temperature, the higher the heat demand. In other embodiments, the auxiliary pump may be operated based on a temperature of the turbine, which may be estimated based on engine temperature as sensed by a temperature sensor (such as sensor 116 of FIG. 2). In other conditions, the auxiliary pump may be operated based on engine speed, load, torque, etc.

The main coolant pump 314 may be mechanically driven by one or more belts or pulleys (not shown) coupled to the engine 10. In this way, the main coolant pump 314 may be operated as a function of engine speed, and may be shut down when the engine is not operating, such as during an automatic stop of the engine. The auxiliary coolant pump 320, which as explained above may be operated independently of the engine, may be operated to provide cooling to the engine under conditions where the main coolant pump 314 is shut down and when engine cooling is indicated, such as when a passenger cabin heater is on.

It is expedient if the cabin heat exchanger circuit is connected to the cylinder head coolant jacket, and it is furthermore advantageous if provision is made to route a line from the outlet side of the cylinder head to the turbine casing, which is connected to the cabin heat exchanger.

It is advantageous if the control element, namely the single-acting check valve, is arranged on the outlet side of the cylinder block, i.e. on the opposite side from the connecting line opening into the latter, in a line leading to the cabin heat exchanger circuit. It is fully in accordance with the disclosure that the control element may also be arranged at other locations, e.g. between the turbine casing and the cabin heat exchanger in order, for example, to reduce the energy consumption of the auxiliary coolant pump.

The main coolant pump, which is preferably embodied as a mechanical pump, preferably coupled mechanically to the crankshaft, is advantageously arranged in such a way that these areas of the internal combustion engine, which are subject to high thermal stress, e.g. the cylinder head, especially the outlet side thereof with the integrated exhaust manifold and also the turbine casing, are supplied with the necessary flow of coolant. The auxiliary coolant pump, which is preferably embodied as an electric pump, preferably electrically driven, i.e. not coupled to the crankshaft, is arranged in such a way that these areas of the internal combustion engine, which are subject to friction but little thermal stress, are supplied with the necessary flow of coolant.

According to the disclosure, the operation or control strategy for the main coolant pump and the auxiliary coolant pump is then implemented in accordance with operating states of the internal combustion engine.

Thus, provision is made for the main coolant pump to deliver coolant during the warm-up phase if no demand for cabin heating is detected during the warm-up phase. In this operating state, the auxiliary coolant pump is inactive. In accordance with the disclosure, the main coolant pump delivers coolant when the engine is running. If there is no demand for heating and the engine is in the warm-up phase, energy should not be withdrawn unnecessarily from the engine—the auxiliary coolant pump is not activated. The same applies if a moderate demand for cabin heating is detected during the warm-up phase.

If, on the other hand, an extensive demand for cabin heating, that is to say full heating power for example, is detected during the warm-up phase, not only the main coolant pump but also the auxiliary coolant pump are activated, with the auxiliary coolant pump being set to its maximum power.

If the internal combustion engine is in a stop state, owing to a stop state of an automatic start/stop system for example, and a demand for cabin heating is detected, the main coolant pump is inactive, i.e. does not deliver a flow of coolant, while the auxiliary coolant pump is simultaneously operated at maximum power, with the result that coolant circulates in the cabin heat exchanger circuit, flowing through the cylinder block.

If a high-demand operating state, which can also be referred to as "crazy driver mode", is detected, i.e. a high load on the engine immediately after a cold start, both the main coolant pump and the auxiliary coolant pump are operated, with the auxiliary coolant pump being operated at full power.

If the system detects that the internal combustion engine is being operated at high load or speed, both the main coolant pump and the auxiliary coolant pump are active, with the auxiliary coolant pump preferably being operated at full power.

If the system detects that the internal combustion engine stops after a high load demand, for example, e.g. by reason of the automatic start/stop system owing to the stop state, and the "hot soak phase" is simultaneously detected, the main coolant pump is inactive, while the auxiliary coolant pump is operated at full power, with the result that coolant circulates in the cabin heat exchanger circuit, flowing through the cylinder block, and cools the turbine casing. The heat absorbed can be used to warm the cabin.

If, in contrast to the high demand operating state, a normal operating state of the internal combustion engine is detected, the main coolant pump and the auxiliary coolant pump are operated, with the auxiliary coolant pump being operated at maximum power or according to sawtooth profile control (pulse-width modulated, PWM, on/off sawtooth profile).

With the advantageous arrangement both of the main coolant pump and of the auxiliary coolant pump and also through the use of the simple check valve, and with the control strategy according to the disclosure, many advantages can be achieved.

For example, rapid warm-up of the cylinder liners and the engine oil is advantageously achieved by reducing heat transfer to the coolant after starting (e.g., cold starting) of the internal combustion engine in a warm-up phase with the no-flow strategy for the components subject to friction. It is also advantageous that the internal combustion engine or the block coolant jacket thereof can be operated independently of temperature monitoring for the components subject to friction by simply controlling the auxiliary coolant pump in an appropriate manner in order to generate a flow of coolant. Moreover, the internal combustion engine has a considerably longer service life since the flow of coolant to components subject to high thermal stress (e.g. cylinder head, turbine casing) at high load is such that there is a considerable reduction in thermal stress and hence failure. When the internal combustion engine stops, e.g. owing to the stop state of the automatic start/stop system, sufficient heating performance is obtained from the cabin heat exchanger by activating the auxiliary coolant pump and using the thermal capacity of the internal combustion engine (e.g. turbine casing, cylinder head). The risk of component damage during the "hot soak phase" is also eliminated since the components that are subject to critical thermal stress (e.g. turbine casing, integrated exhaust manifold) are sufficiently well cooled by operating the auxiliary coolant pump when the main coolant pump is inactive. Since the main coolant pump is operated continuously while the internal combustion engine is operating, energy consumption is also reduced since the auxiliary coolant pump can be designed for a lower power consumption.

Also evident is the advantage of the significantly less complicated construction of the cooling system according to the disclosure, thereby also making it possible to reduce costs. While conventional main coolant pumps serve to maintain the endurance of the cylinder head and the cylinder block during the operation of the internal combustion engine, the endurance of the turbocharger, especially the turbine side thereof, is furthermore improved according to the disclosure by the main coolant pump.

While the auxiliary coolant pump conventionally serves to improve the endurance of the turbocharger in the "soak phase" and to bring about a flow of coolant through the cabin heat exchanger, the endurance of components subject to low thermal stress (e.g. cylinder block) is furthermore improved according to the disclosure by the auxiliary coolant pump. Typically, an additional valve is furthermore provided in the block water jacket (split cooling). According to the disclosure, however, a simple check valve is provided, and said check valve can be used to bring about variable flow through the block in the warm-up phase, thus enabling heat transfer to be controlled virtually in a continuously variable manner.

Figure 4:
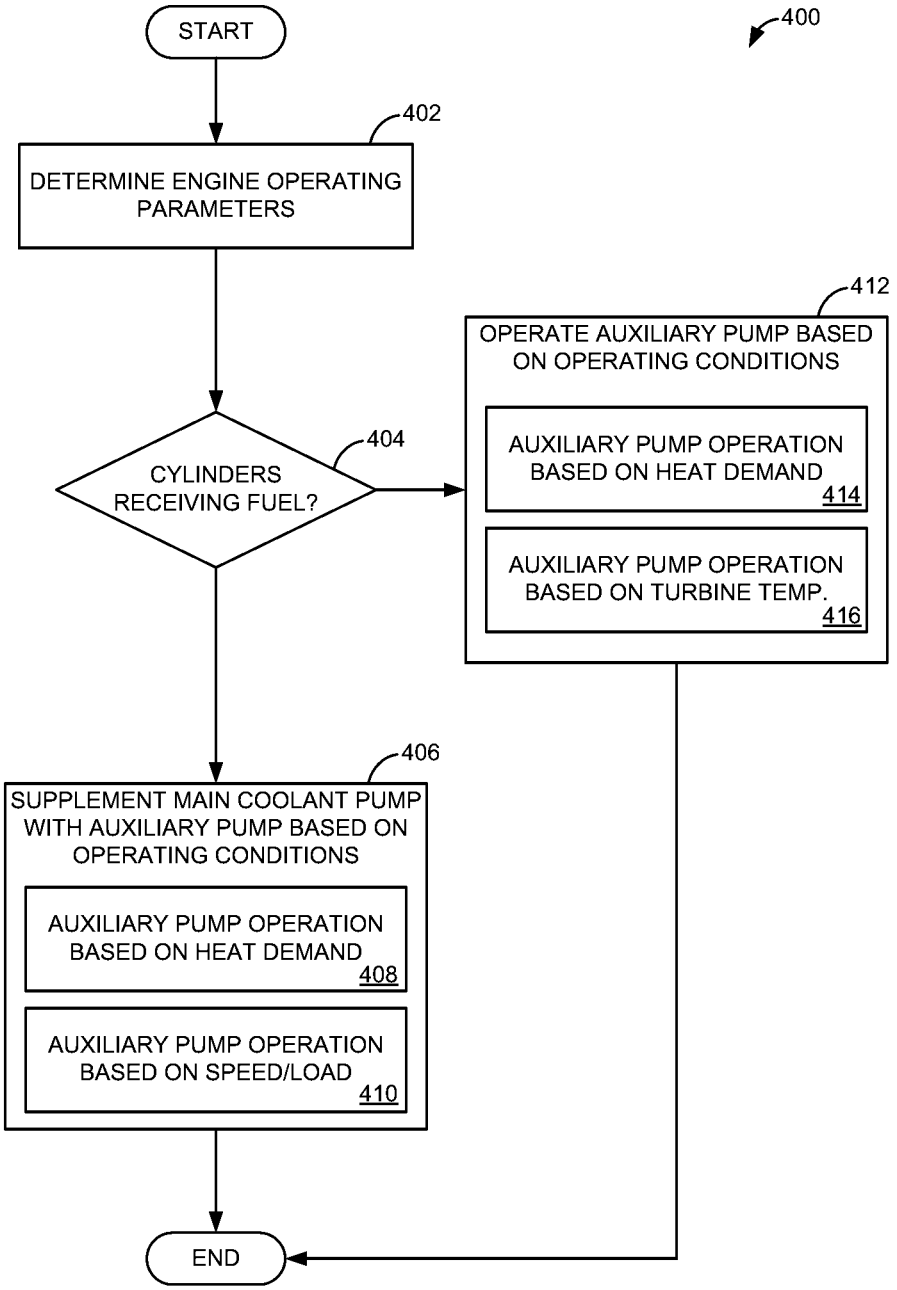
FIG. 4 shows a flow chart illustrating a method for cooling an engine according to an embodiment of the present disclosure.

FIG. 4 shows a method 400 for cooling an engine according to an embodiment of the present disclosure. Method 400 may be carried out by a control system of an engine, such as controller 12, using the components of a cooling system, such as cooling system 300. Method 400 comprises, at 402, determining engine operating parameters. The operating parameters may include engine torque, engine speed, coolant temperature, throttle valve position, brake pedal position, and/or accelerator pedal position and the vehicle speed. At 404, it is determined whether the cylinders are receiving fuel. During an automatic stop of an engine, the cylinders will not receive fuel in order to shut down the engine. Such conditions are met, for example, if the brake pedal in a traveling vehicle is activated and a vehicle speed is below a threshold, such as less than approximately 5 km/h and particularly preferably approximately 0 km/h (stop condition vehicle speed). Alternatively or additionally to this, the stop condition can also be determined by rapid closing of the throttle valve or the position of the accelerator pedal and the previously mentioned stop condition vehicle speed. The stop condition for an automatic stop as utilized herein may refer to a stop condition determined by a controller without an operator of the vehicle indicating an engine shut down, such as without an operator switching off an ignition key. When the automatic stop conditions are satisfied, controller 12 may initiate an engine shutdown by shutting off fuel and spark to the engine. However, in these conditions, external engine components may still be operated, as described below.

If it is determined that the cylinders are receiving fuel, method 400 proceeds to 406 to supplement a main coolant pump with an auxiliary coolant pump, dependent on operating conditions. As explained above, the main coolant pump may be operated as a function of engine speed. The auxiliary pump may be controlled by the controller to provide additional cooling and/or lubrication to the engine based operating parameters. In one example, the auxiliary pump may be operated based on heat demand at 408. The heat demand may be the extent to which heat is requested in a passenger cabin of the vehicle. If the heat demand is above a threshold that the coolant loop operated by the main pump cannot solely provide, the auxiliary pump may be operated such that coolant can be heated by the block coolant jacket and routed to the head coolant jacket for eventual heat exchange to the cabin in the cabin heat exchanger. In addition to operating the auxiliary pump, it may be controlled to a speed high enough so that the coolant pressure at the outlet of the block coolant jacket is sufficient to open the check valve arranged therein.

In another example, the auxiliary coolant pump may be operated based on engine speed and load at 410. If speed and/or load are above a threshold, for example during a high demand phase of the engine, cooling provided by the main coolant pump may not adequately cool the engine. The auxiliary pump may be operated to additionally cool the cylinder block.

If it is determined at 404 that the cylinders are not receiving fuel (e.g. the engine is in an automatic stop), method 400 proceeds to 412 to operate the auxiliary coolant pump based on operating conditions. Because the cylinders are not receiving fuel, the main coolant pump is not operated. As such, any routing of coolant is done by the auxiliary coolant pump. This includes operating the auxiliary coolant pump based on heat demand at 414. When a vehicle is an automatic stop, the engine is not running but accessory systems, such as cabin heating, may be operating. As such, the auxiliary coolant pump can be operated at 414 to route coolant through the block and head coolant loops to the heat exchanger to provide heat to the passenger cabin.

In other example, the auxiliary pump may be operated based on turbine temperature at 416. As the turbine is subject to high exhaust temperatures, it may be cooled by the head coolant loop to prevent damage to the turbine. Under normal engine operating conditions, this includes coolant routed to the turbine via the main pump. However, when the engine is not operating, such as during an automatic stop, coolant flow from the main pump ceases. To ensure additional cooling following engine shutdown after an automatic stop, the auxiliary pump may be operated at 416 to provide coolant flow to the turbine.

The cooling strategy of method 200 can be described in accordance with the operating state of the internal combustion engine, using Table 1 below:

TABLE 1

| Operating state | Main coolant pump | Auxiliary coolant pump |
|---|---|---|
| Warm-up phase - without cabin heating | active | not active |
| Warm-up phase - moderate cabin demand | active | not active |
| Warm-up phase - extensive cabin demand | active | max. power |
| Cabin heating on when engine stopped | not active | max. power |
| Warm-up phase - high demand | active | max. power |
| High load/speed | active | max. power |
| Soak after engine stopped | not active | max. power |
| Normal operation | active | max. power or adapted power if PWM |

Thus, the methods and systems above provide for a method for cooling an engine of a vehicle comprising during a warm-up phase of the engine, operating a main coolant pump to flow coolant through a first coolant loop, and operating an auxiliary coolant pump to flow coolant through a second coolant loop based on a heating demand of a passenger cabin of the vehicle. The method also includes, during an automatic stop condition of the engine where the engine is automatically shut down, shutting down the main coolant pump and operating the auxiliary coolant based on the heating demand. The method includes during an automatic stop condition of the engine where the engine is automatically shut down, shutting down the main coolant pump and operating the auxiliary coolant based on a temperature of a turbine coupled to the engine. The method includes operating both the main coolant pump and the auxiliary coolant pump when engine speed and load are above a threshold. Operating the auxiliary coolant pump to flow coolant through the second coolant loop based on the heating demand of a passenger cabin of the vehicle may further comprise operating the auxiliary coolant pump when the heating demand is above a threshold.

The methods and systems also provide a cooling system for an engine of a vehicle comprising a first coolant loop including a main coolant pump, a cylinder head coolant jacket, a turbine in a turbine casing, and a heat exchanger, a second coolant loop including an auxiliary coolant pump, a cylinder block coolant jacket, and a check valve, and a control system including instructions to during an automatic stop of the engine, operate the auxiliary pump based on a heat demand of a passenger cabin of the vehicle. The control system also includes instructions to, during an automatic stop of the engine, operate the auxiliary pump based on a temperature of the turbine. The control system also includes instructions to, when a temperature of the coolant is below a threshold, operate the auxiliary pump based on the heat demand. The main coolant pump is mechanically driven by the engine, and the auxiliary coolant pump is electrically driven by an external motor controlled by the control system.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An internal combustion engine that has a cooling system of a split-cooling type, comprising:

a first coolant loop including a main coolant pump that pumps coolant through a cylinder head coolant jacket;

a second coolant loop including a connecting line fluidically coupled to an inlet of a cylinder block coolant jacket;

an auxiliary coolant pump arranged in the connecting line; and a coolant-pressure-opened check valve positioned in a line fluidically coupled to an outlet of the cylinder block coolant jacket, the line fluidically coupled to a coolant line of the first coolant loop at a location between the main coolant pump and an inlet of the cylinder head coolant jacket, the check valve controlling flow of coolant from the cylinder block coolant jacket to the first coolant loop based on a pressure of the coolant between the cylinder block coolant jacket and the check valve.

2. The internal combustion engine as claimed in claim 1, wherein the first coolant loop includes a cabin heat exchanger, wherein the check valve is a simple ball and spring check valve.

3. The internal combustion engine as claimed in claim 2, wherein the first coolant loop flows coolant through a turbine casing of a turbocharger.

4. The internal combustion engine as claimed in claim 2, wherein the main coolant pump is a mechanical pump, and the auxiliary coolant pump is an electric pump.

5. The internal combustion engine as claimed in claim 2, wherein the main coolant pump delivers coolant and the auxiliary coolant pump is inactive during a warm-up phase if no demand for cabin heating or a moderate demand for cabin heating is detected.

6. The internal combustion engine as claimed in claim 2, wherein the main coolant pump and the auxiliary coolant pump are activated if an extensive demand for cabin heating is detected during a warm-up phase.

7. The internal combustion engine as claimed in claim 2, wherein the main coolant pump is inactivated and the auxiliary coolant pump is operated at maximum power, such that coolant circulates in the first coolant loop and the second coolant loop, flowing through a cylinder block, if the internal combustion engine is in a stop state, and a demand for cabin heating is detected, and/or if a "hot soak phase" is detected.

8. The internal combustion engine as claimed in claim 2, wherein both the main coolant pump and the auxiliary coolant pump are operated if a high demand operating state is detected and/or if the system detects that the internal combustion engine is being operated at high load or speed.

9. A method for cooling an engine of a vehicle, comprising:

during a warm-up phase of the engine, operating a main coolant pump to flow coolant through a first coolant loop including a cylinder head coolant jacket; and operating an auxiliary coolant pump to flow coolant through a second coolant loop including a cylinder block coolant jacket based on a heating demand of a passenger cabin of the vehicle, where the auxiliary coolant pump is operated at a controlled speed to flow the coolant through the cylinder block coolant jacket at a threshold pressure to open a check valve coupled between the cylinder block coolant jacket and the first coolant loop, the coolant through the second coolant loop flowing from the cylinder block coolant jacket, through the check valve, and to the first coolant loop.

10. The method of claim 9, further comprising during an automatic stop condition of the engine where the engine is automatically shut down, shutting down the main coolant pump and operating the auxiliary coolant pump based on the heating demand.

11. The method of claim 9, further comprising during an automatic stop condition of the engine where the engine is automatically shut down, shutting down the main coolant pump and operating the auxiliary coolant pump based on a temperature of a turbine coupled to the engine.

12. The method of claim 9, further comprising operating both the main coolant pump and the auxiliary coolant pump when engine speed and load are above a threshold.

13. The method of claim 9, wherein operating the auxiliary coolant pump to flow coolant through the second coolant loop based on the heating demand of the passenger cabin of the vehicle further comprises operating the auxiliary coolant pump when the heating demand is above a threshold.

14. A cooling system for an engine of a vehicle, comprising:

a first coolant loop including a main coolant pump, a cylinder head coolant jacket, a turbine in a turbine casing, and a heat exchanger;

a second coolant loop including an auxiliary coolant pump, a cylinder block coolant jacket, and a check valve that opens based on a pressure of coolant exiting the cylinder block coolant jacket to allow flow from the cylinder block coolant jacket to the cylinder head coolant jacket; and a control system including instructions to:

during an automatic stop of the engine, operate the auxiliary pump based on a heat demand of a passenger cabin of the vehicle, where the auxiliary coolant pump is operated at a controlled speed to flow coolant through the cylinder block coolant jacket at a threshold pressure to open the check valve.

15. The cooling system of claim 14, wherein the control system includes instructions to, during the automatic stop of the engine, operate the auxiliary pump based on a temperature of the turbine.

16. The cooling system of claim 14, wherein the control system includes instructions to, when a temperature of the coolant is below a threshold, operate the auxiliary pump based on the heat demand.

17. The cooling system of claim 14, wherein the main coolant pump is mechanically driven by the engine, and wherein the auxiliary coolant pump is electrically driven by an external motor controlled by the control system.

* * * * *